US007213381B2

(12) United States Patent
Zitella et al.

(10) Patent No.: US 7,213,381 B2
(45) Date of Patent: May 8, 2007

(54) APPARATUS FOR APPLYING EXTERNAL CORNER OR EDGE PROTECTORS ONTO EXTERNAL CORNER OR EDGE REGIONS OF PACKAGES OR PALLETIZED LOADS

(75) Inventors: Marco Zitella, Montreal (CA); Faruk Turfan, Brossard (CA)

(73) Assignee: Illinois Tool Works Inc., Glenview, IL (US)

( * ) Notice: Subject to any disclaimer, the term of this patent is extended or adjusted under 35 U.S.C. 154(b) by 72 days.

(21) Appl. No.: 11/139,650

(22) Filed: May 31, 2005

(65) Prior Publication Data

US 2006/0266002 A1 Nov. 30, 2006

(51) Int. Cl.
*B65B 61/00* (2006.01)
*B65B 11/00* (2006.01)

(52) U.S. Cl. ..... 53/139.7

(58) Field of Classification Search ..... 53/139.7
See application file for complete search history.

(56) References Cited

U.S. PATENT DOCUMENTS 5,390,476 A 2/1995 Morantz
5,423,118 A * 6/1995 Lotti ..... 53/139.7
5,535,572 A 7/1996 Morantz et al.
5,546,730 A * 8/1996 Newell et al. ..... 53/139.7
6,178,721 B1 1/2001 Turfan
6,508,044 B2 1/2003 Suolahti
2003/0051439 A1* 3/2003 Lancaster et al. ..... 53/139.7
2004/0261360 A1* 12/2004 Cere ..... 53/139.7

* cited by examiner

*Primary Examiner*—Stephen F. Gerrity
(74) *Attorney, Agent, or Firm*—Schwartz & Weinrieb

(57) ABSTRACT

Apparatus for placing external corner protectors upon the external corner regions of palletized loads, prior to the wrapping of the palletized loads within wrapping material, comprises four corner protector pickup, transfer, and applicator mechanisms respectively disposed adjacent to the four corner regions of the palletized load, wherein the corner protector pickup, transfer, and applicator mechanisms are movable independently of the external corner protector magazine assemblies. The external corner protector pickup, transfer, and applicator mechanisms are rotatably mounted upon rotatable actuators which are rotatably movable through angular movements comprising 270°, and, in turn, the rotary actuators are mounted upon linearly movable mechanisms which are movable in both X and Y directions. The external corner protector magazine assemblies, and the external corner protector pickup, transfer, and applicator mechanisms operatively associated therewith, are therefore capable of being oriented either in a parallel mode, or in a perpendicular mode, with respect to the longitudinal extent of the conveyor system which conveys the palletized load into and out from the wrapping station.

15 Claims, 8 Drawing Sheets

APPARATUS FOR APPLYING EXTERNAL CORNER OR EDGE PROTECTORS ONTO EXTERNAL CORNER OR EDGE REGIONS OF PACKAGES OR PALLETIZED LOADS

FIELD OF THE INVENTION

The present invention relates generally to apparatus or a system for wrapping or packaging palletized loads or articles, and more particularly to apparatus or a system for placing external corner or edge protectors upon the corner or edge regions of palletized loads or articles, prior to the wrapping or packaging thereof, wherein four corner or edge protector pickup, transfer, and applicator mechanisms are respectively disposed adjacent to the four corner or edge regions of the palletized load or article, wherein the corner or edge protector pickup, transfer, and applicator mechanisms are movable independently of the corner or edge protector magazine assemblies, each one of which houses a supply of corner or edge protectors within a vertically oriented serial array, and wherein the corner or edge protector pickup, transfer, and applicator mechanisms are rotatably mounted upon rotatable actuators which are rotatably movable through angular movements comprising 270° and which, in turn, are mounted upon linearly movable mechanisms which are effectively movable in both the X and Y directions, whereby the corner or edge protector magazine assemblies, and the corner or edge protector pickup, transfer, and applicator mechanisms operatively associated therewith, are capable of being oriented either in a parallel mode, or in a perpendicular mode, with respect to the longitudinal extent of the conveyor system which conveys the palletized load or article, to be wrapped or packaged, into the wrapping or packaging station, and which conveys the wrapped or packaged palletized load or article out from the wrapping station.

BACKGROUND OF THE INVENTION

Apparatus for wrapping or packaging a palletized load or article generally comprises a stationary or fixed framework defining a wrapping station for receiving the palletized load or article to wrapped within wrapping or packaging material, and a movable framework which is mounted upon the stationary or fixed framework in a vertically reciprocable manner or mode of operation. The movable framework has a wrapping material dispensing unit rotatably mounted thereon for rotation around a vertical axis defined at the wrapping station at which each one of the palletized loads or articles is disposed so as to be wrapped within the packaging or wrapping material, and accordingly, as the movable framework is moved vertically along the fixed or stationary framework, the wrapping material dispensing unit is rotated around the palletized load or article so as to completely encase the palletized load or article within the wrapping or packaging material. The palletized load or article to be wrapped or packaged usually comprises opposed pairs of vertical sides, wherein adjacent sides of the palletized load or article meet at an angle so as to define a plurality of vertically oriented corner or edge regions, and in order to protect the vertically oriented corner or edge regions of the palletized load or article from being damaged during transportation, shipping, storage, or the like, vertically oriented corner or edge protectors, fabricated, for example, from paper or paperboard material, are applied to or mounted upon the vertically oriented corner or edge regions of the palletized load or article prior to the wrapping or packaging of the same within the wrapping or packaging material.

The apparatus for applying the vertically oriented corner or edge protectors onto the vertically oriented corner or edge regions of the palletized load or article generally comprises, for each vertically oriented corner region of the palletized load or article, a magazine for storing a plurality or supply of the vertically oriented corner or edge protectors, and a pickup, transfer, and applicator mechanism operatively associated with the magazine for removing a leading one of the vertically oriented corner or edge protectors from the magazine, for transferring the removed corner or edge protector toward the particular or corresponding corner or edge portion of the palletized load or article, and for applying the vertically oriented corner or edge protector onto the particular vertically oriented corner or edge region of the palletized load or article. One such type of apparatus which has heretofore been proposed, and which is currently well-known in the industry, is that disclosed within U.S. Pat. No. 5,535,572 which issued to Morantz et al. on Jul. 16, 1996. More particularly, as can best be appreciated from FIG. 1, which corresponds to FIG. 2 of the aforenoted patent to Morantz et al., it is seen that the exemplary, conventional, PRIOR ART palletized load or article wrapping or packaging system, generally indicated by the reference character 10, comprises a stationary frame assembly 12, a movable frame assembly 14 movably mounted upon the stationary frame assembly 12 for vertical movement with respect thereto, and a ring member 16 which is supported upon the frame assembly 14 for vertical displacement therewith and which is rotatable around a system axis 18. The stationary frame assembly 12 spans a conveyor 20 which is adapted to convey a palletized load or article L, to be wrapped or packaged, along a flow path P to a wrapping or packaging station, which is located at the axial location 18, in preparation for the wrapping or packaging of the palletized load or article L, and subsequent to the wrapping or packaging of the palletized load or article L, the conveyor 20 will discharge the wrapped or packaged palletized load or article L outwardly from the wrapping or packaging station. A film carriage 22 is mounted upon the ring member 16 for displacement therewith and includes a roll of plastic wrapping or packaging film material which is adapted to be paid out or dispensed during a palletized load or article wrapping or packaging operation.

The palletized load or article L is defined by means of a pair of oppositely disposed end walls 34,36 and a pair of oppositely disposed side walls 38,40 wherein adjacent pairs of the side walls and end walls 34,36,38,40 define four vertically oriented corner regions upon the palletized load or article L which are adapted to be protected by means of vertically oriented corner or edge protectors. Accordingly, a plurality of corner or edge protector magazine and pickup, transfer, and applicator assemblies 44 are provided within the vicinity of each one of the four corner regions of the palletized load or article L such that a pickup, transfer, and applicator assembly 132 can effectively pick up or remove a leading one of a plurality of serially arranged, vertically oriented corner or edge protectors from a magazine assembly 56, transfer the removed corner or edge protector from the magazine assembly 56 toward the particular corner or edge region of the palletized load or article L, and apply the corner or edge protector onto the corner or edge region of the palletized load or article L. More particularly, as can best be appreciated from FIG. 2, which corresponds to FIG. 4 of the patent to Morantz et al., each one of the plurality of corner or edge protector magazine and pickup, transfer, and applicator assemblies 44 is seen to comprise a stationary framework 46 which includes a plurality of vertically oriented corner posts 48, a pair of transversely oriented framework members 50,50 connecting pairs of the corner posts 48 together, and a pair of longitudinally extending frame rail members 52,52 connecting other pairs of the corner posts 48 together. In addition, a pair of longitudinally extending frame members 54,54, having racks 70 formed thereon, also connect the pair of transversely oriented framework members 50,50 together.

A magazine unit 56, for housing a plurality of corner or edge protectors C within a transversely oriented, serial array, is mounted upon a carriage assembly 58 which comprises a carrige support plate 59, and the opposite ends of the support plate 59 are mounted upon carriage wheel units 60 which are rollably disposed upon the longitudinally extending rail members 52,52. A motor 64, mounted upon the undersurface portion of the support plate 59, is adapted to drive pinions, not illustrated, which are disposed in meshed engagement with the racks 70 such that the entire carriage assembly 58, upon which the magazine unit 56 is mounted, can be moved in a reciprocal manner along the longitudinally extending rail members 52,52. It is additionally seen that each one of the pickup, transfer, and applicator assemblies 132 is respectively mounted upon the support plate 59, through means of a support block 134, so as to be movable along with the carriage assembly 58. The support block 134 is mounted upon a pair of guide rods 136 which are slidably mounted within a pair of guide blocks 138 which are mounted upon the support plate 59, and the support block 134 is also attached to the distal end of a piston rod 142 of a cylinder mechanism 140 which is also mounted upon the support plate 59.

The support block 134 comprises a pickup plate 148 which is mounted upon a support plate 150 which is fixedly mounted upon a vertically oriented rotatable shaft 144, and a pinion mechanism 158 is also fixedly mounted upon the rotatable shaft 144. A rack 160 is fixedly mounted upon one of a plurality of vertically orient-ed corner posts 72 of the magazine unit 56, and accordingly, when the support block 134 is driven to the right, as viewed in FIG. 2, from the solid line position to the dotted line position, the pinion mechanism 158 will be enmeshed with and driven by the rack 160 so as to rotate the pickup plate 148 and the vertically oriented shaft 144 around the vertical axis defined by vertically oriented shaft 144. In this manner, the leading one of the edge or corner protectors C will be removed from the magazine unit 56 and angularly pivoted through an angular rotation of 135 so as to be disposed at the dotted line position designated by means of P1,P2 which represent the side members of each corner or edge protector C. When the corner or edge protector C is disposed at such dotted line position, the pickup, transfer, and applicator assembly 132 may then be adjustably positioned still further with respect to the end and side wall members 34,38 of the palletized load or article L by means of piston-cylinder assembly 140,142, as well as by means of drive motor 64 which controls the movement of carriage assembly 58, so as to apply or mount the corner or edge protector C onto the external corner or edge region of the palletized load or article L.

While the aforenoted apparatus of Morantz et al. is quite satisfactory, the structural components, and the operational arrangement of such structural components, comprising the apparatus or system presents some logistical and operational situations which are deemed to need improvement. For example, it is noted, for example, that the pickup, transfer, and applicator assemblies 132 are respectively mounted upon the carriage assembly 58 along with the magazine unit 56 which houses the supply of corner or edge protectors C. Accordingly, a substantial amount of mass, that is, the entire carriage assembly 58 and the magazine unit 56, is required to be moved when each one of the pickup, transfer, and applicator assemblies 132 is moved with respect to a particular one of the external corner or edge regions of the palletized load or article L in order to properly position the leading one of the corner or edge protectors C which has been removed from a respective one of the magazine units 56. This massive movement of the aforenoted structural components necessitates a slow movement of the pickup, transfer, and applicator assemblies 132 with respect to the external corner or edge regions of the palletized load or article L, or the use of larger motor drive units. It is further noted that since each magazine unit 56 and each pickup, transfer, and applicator assembly 132 is mounted upon the movable carriage assembly 58, then when the supply of corner or edge protectors C needs to be replenished, operator personnel must perform such replenishment operation either while the carriage assembly 58 is in motion, such as, for example, when each one of the pickup, transfer, and applicator assemblies 132 is being moved toward an external corner region of the palletized load or article L so as to position the leading one of the corner or edge protectors C onto the external corner or edge region of the palletized load or article L, or when each one of the pickup, transfer, and applicator assemblies 132 is being moved away from the external corner region of the palletized load or article L so as to permit the wrapping or packaging process for the palletized load or article L to be completed. The performance of such a replenishment operation during such movements of the carriage assembly 58 is obviously dangerous or potentially hazardous to operator personnel.

Alternatively, such a replenishment operation may conceivably be performed after the pickup, transfer, and applicator assemblies 132 have been moved away from the external corner region of the palletized load or article L so as to permit the wrapping or packaging of the palletized load or article L to be completed, or still further, when the wrapped or packaged palletized load or article is being discharged from the wrapping or packaging station by means of the conveyor mechanism 20, while a new palletized load or article L is being conveyed into the wrapping or packaging station in preparation for the commencement of a new wrapping or packaging operation. However, the time window for accomplishing such a corner or edge protector replenishment operation may be relatively short, and if the replenishment operation is not in fact completed when the next wrapping or packaging operation is to be performed, the system experiences operational downtime which causes a loss in productivity.

Lastly, it is noted that in accordance with the structural arrangement and actuating mechanisms comprising the pickup, transfer, and applicator assemblies 132, and the mounting of the same upon the carriage assembly 58, the plurality of pickup, transfer, and applicator assemblies 132 are only able to undergo angular rotation through means of an angular extent comprising 135° of movement. Accordingly, as can best be appreciated from FIG. 2, in order to permit the pickup, transfer, and applicator assemblies 132 to undergo such angular or pivotal movement from the solid line position to the dotted line position so as to properly position the same, as well as the leading one of the external corner or edge protectors C disposed thereon, with respect to a respective one of the external corner or edge regions of the palletized load or article L, the plurality of corner or edge protector magazine and pickup, transfer, and applicator assemblies 44 must be positioned in a transverse or perpendicular mode or orientation with respect to the longitudinal extent of the conveyor 20. This arrangement requires a larger amount of floor space to be allocated to the entire packaging or wrapping machinery or apparatus 10.

A need therefore exists in the art for a new and improved apparatus or system for applying vertically oriented external corner or edge protectors onto vertically oriented external corner or edge regions of a palletized load or article wherein the magazine assemblies for housing or storing supplies of the plurality of external edge or corner protectors are stationary so as not to present a hazardous environment for operator personnel during the replenishment of the supplies of the external corner or edge protectors within the magazine assemblies, wherein the external corner or edge protector pickup, transfer, and applicator mechanisms are movable independently of their operatively associated magazine assemblies such that the mass which is required to be moved in order to remove the leading one of the external corner or edge protectors from each one of the magazine assemblies, to transfer the removed external corner or edge protector toward the external corner or edge region of the palletized load or article disposed at the wrapping or packaging station, and to apply the external corner or edge protector onto the external corner or edge region of the palletized load or article is minimized whereby the controlled movements of the external corner or edge protector pickup, transfer, and applicator mechanisms are able to be performed faster and with smaller motor drive mechanisms, and wherein the external corner or edge protector pickup, transfer, and applicator mechanisms are rotatably or pivotally movable through angular movements or extents of 270° so as to permit the external corner or edge protector magazine and pickup, transfer, and applicator assemblies to be optionally oriented in both parallel and perpendicular modes with respect to the longitudinal extent of the palletized load or article conveyor mechanism which conveys the palletized loads or articles into the wrapping or packaging station, and which discharges the palletized loads or articles out from the wrapping or packaging station, whereby the floor space of the manufacturing or fabrication facility can be optimized.

SUMMARY OF THE INVENTION

The foregoing and other objectives are achieved in accordance with the teachings and principles of the present invention through the provision of a new and improved external corner or edge protector magazine and pickup, transfer, and applicator assembly, for use in conjunction with apparatus or a system for wrapping or packaging palletized loads or articles within wrapping or packaging material, wherein each magazine assembly, for housing or storing a supply of external corner or edge protectors, is stationary, and wherein further, the external corner or edge protector pickup, transfer, and applicator mechanism is mounted upon the magazine assembly so as to be movable independently of the magazine assembly in X and Y directions so as to be movable relative to the external corner or edge region of the palletized load or article in order to properly position the external corner or edge protector with respect to the external corner or edge region of the palletized load or article. In this manner, the mass, which is required to be moved in order to remove the leading one of the external corner or edge protectors from the magazine assembly, to transfer the removed external corner or edge protector toward the external corner or edge region of the palletized load or article disposed at the wrapping or packaging station, and to apply the external corner or edge protector onto the external corner or edge region of the palletized load or article is minimized whereby the controlled movements of the external corner or edge protector pickup, transfer, and applicator mechanism are able to be performed faster and with smaller motor drives. In addition, such a structural arrangement does not present a hazardous environment for operator personnel during the replenishment of the supply of external corner or edge protectors within each magazine assembly. Still further, the external corner or edge protector pickup, transfer, and applicator mechanisms are rotatably or pivotally movable through angular movements or extents of 270° so as to permit the external corner or edge protector magazine and pickup, transfer, and applicator assemblies to be optionally oriented in both parallel and perpendicular modes with respect to the longitudinal extent of the palletized load or article conveyor mechanism which conveys the palletized loads or articles into and out from the wrapping or packaging station. In this manner, floor space within the manufacturing or fabrication facility can be optimized.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
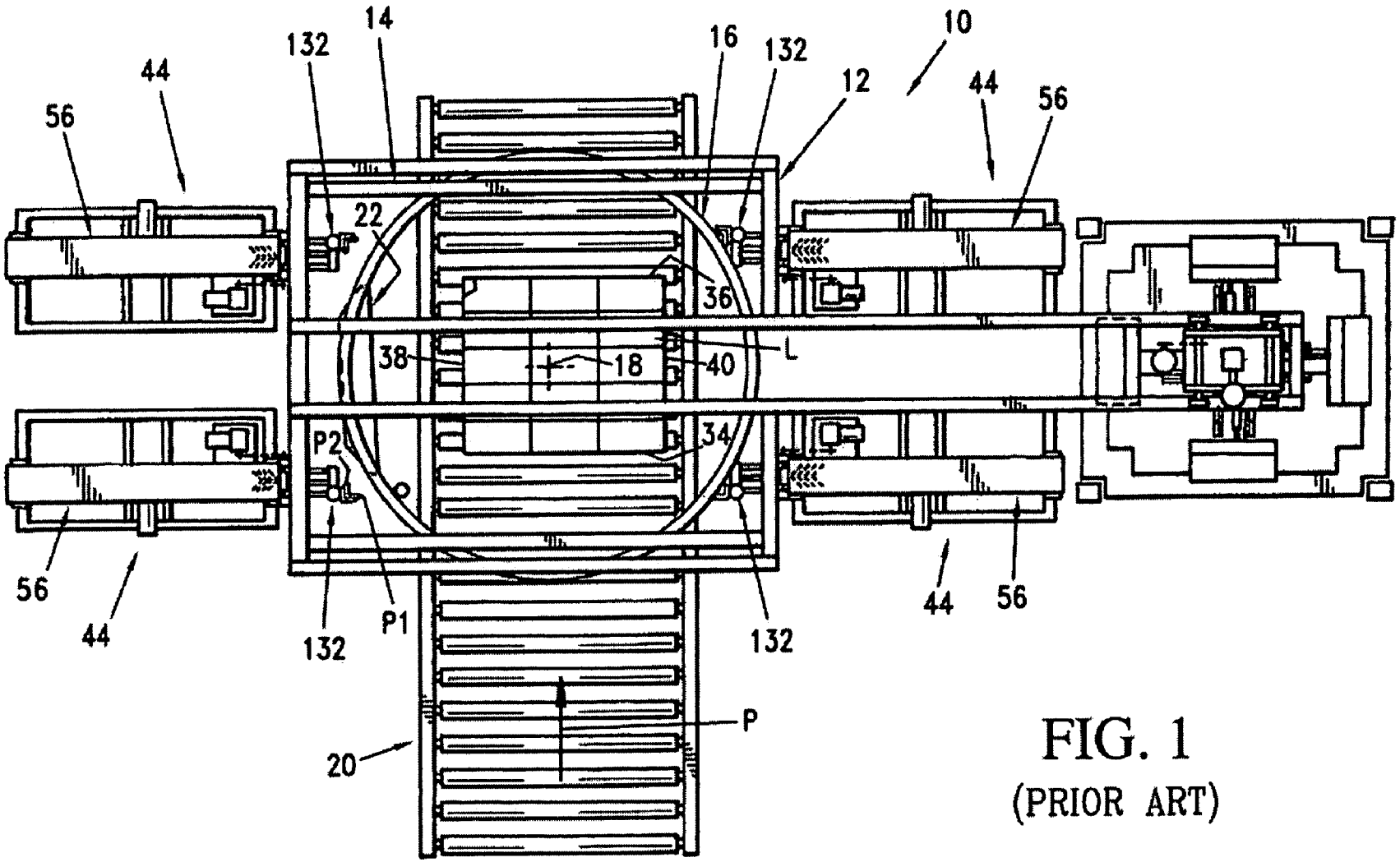
FIG. 1 (PRIOR ART)
FIG. 1 is a top plan view of a conventional, PRIOR ART apparatus or system for wrapping or packaging palletized loads or articles within wrapping or packaging material.
Figure 2:
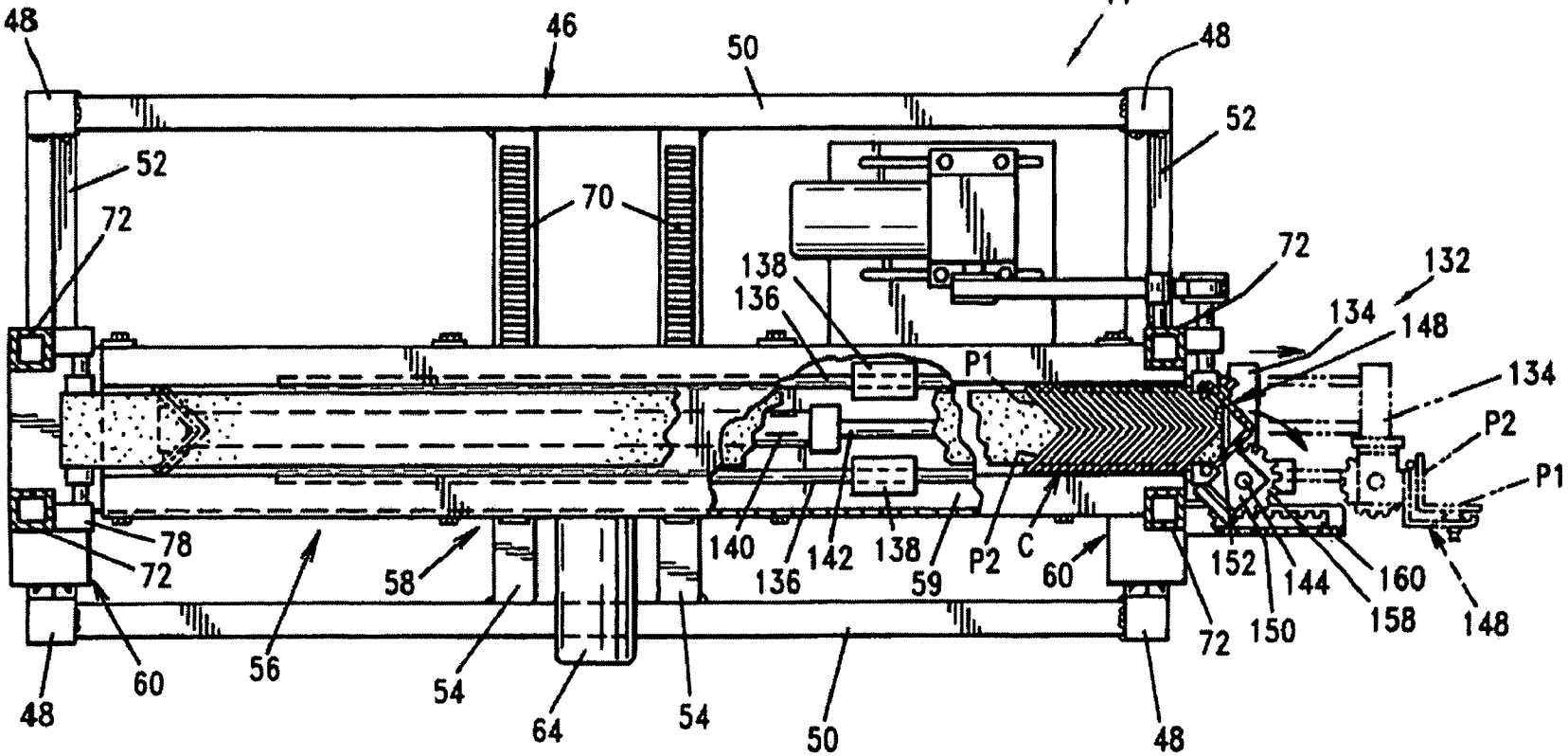
FIG. 2 (PRIOR ART)
FIG. 2 is a top plan view of one of the magazine and pickup, transfer, and applicator assemblies of the conventional, PRIOR ART palletized load or article wrapping or packaging apparatus or system as disclosed within FIG. 1.

Referring now to the drawings, and more particularly to FIGS. 3–7 thereof, a new and improved external corner or edge protector magazine and pickup, transfer, and applicator assembly, for use in conjunction with an apparatus or system for wrapping or packaging palletized loads or articles within wrapping or packaging material, as constructed in accordance with the principles and teachings of the present invention, is disclosed and is generally indicated by the reference character 210. More particularly, it is seen that the new and improved apparatus or system 210, for picking up, transferring, and applying vertically oriented external corner or edge protectors onto the vertically oriented corner or edge regions of palletized loads or articles, is seen to comprise a stationary framework which comprises a plurality of laterally and longitudinally spaced, vertically oriented, upstanding standards 212,214,216,218 which are disposed within the four corner regions of the stationary framework, a first pair of longitudinally extending upper and lower structural beam members 220,222 which effectively interconnect the longitudinally spaced, vertically oriented, upstanding standards 212,216 together, and a second pair of longitudinally extending upper and lower structural beam members 224, 226 which are laterally or transversely spaced from the first pair of longitudinally extending upper and lower structural beam members 220,222 and which effectively interconnect the longitudinally spaced, vertically oriented, upstanding standards 214,218 together.

In addition, a transversely or laterally extending structural beam member 228 effectively interconnects the laterally or transversely spaced, upper, longitudinally extending structural beam members 220,224 together, and a pair of transversely or laterally spaced, vertically oriented, upstanding masts 230,232 are respectively fixedly attached to the transversely or laterally extending structural beam member 228 by means of suitable mounting brackets 234,236. Still yet further, and with particular reference being made to FIGS. 3 and 4, a pair of transversely or laterally spaced support or mounting platforms 238,240 are respectively affixed atop the upper, laterally or transversely spaced, longitudinally extending structural beam members 220,224, as well as atop the opposite ends of the transversely or laterally extending structural beam member 228, and a transversely or laterally extending plate member 242 has its opposite ends fixedly secured atop the laterally or transversely spaced support or mounting platforms 238,240. A first set of longitudinally spaced, transversely or laterally extending beam members 244,246 are fixedly disposed atop the plate member 242, and it is seen that each one of the transversely or laterally extending beam members 244,246 has a substantially inverted L-shaped cross-sectional configuration whereby the pair of transversely or laterally extending beam members 244,246 operatively cooperate with the transversely or laterally extending plate member 242 so as to effectively define a trough assembly within which the upper run of a first lower endless loop conveyor belt member, not shown, is adapted to be movably guided.

The upper run of the first lower conveyor belt member, not shown, forms part of a magazine assembly for housing and serially conveying a plurality of vertically oriented external corner or edge protectors, also not shown, toward an external corner or edge protector pickup, transfer, and applicator mechanism 248, which will be discussed further in detail hereinafter, whereby a leading one of the vertically oriented external corner or edge protectors, not shown, can be properly positioned with respect to the external corner or edge protector pickup, transfer, and applicator mechanism 248 so as to be picked up by means of the external corner or edge protector pickup, transfer, and applicator mechanism 248 in preparation for being transferred toward and applied onto the external corner or edge region of a palletized load or article. In connection with the first lower endless loop conveyor belt member, not shown, a first conveyor belt drive pulley 250, and a first conveyor belt idler pulley 252, are disposed laterally outwardly of the opposite ends of the trough assembly comprising the laterally or transversely extending plate member 242 and beam members 244,246, and it is additionally seen that a first mounting bracket 254 is fixedly secured beneath the left end portion of the transversely or laterally extending structural beam member 228, as viewed within FIG. 3, such that a first drive motor-gear reducer assembly 256 can be fixedly mounted upon the undersurface portion of the first mounting bracket 254.

The output drive shaft 257 of the first drive motor gear reducer assembly 256 has a drive pulley 258 rotatably mounted thereon, and the drive pulley 258 is operatively connected to a driven pulley 260 by means of pulley drive belt 262. The driven pulley 260 drives the first conveyor drive pulley 250 through means of a first horizontally oriented drive shaft 264, and a first transmission gear member 266 is fixedly mounted upon the first drive shaft 264 so as to be rotatable around a horizontal axis, defined by means of the first drive shaft 264, in the counterclockwise direction as viewed from the end of the first drive shaft 264 upon which the driven pulley 260 is mounted. The first transmission gear member 266 is enmeshed with a first rotary gear member 268 which is rotatable around a vertical axis, and it is seen that the first rotary gear member 268 is fixedly mounted upon the lower end portion of a vertically oriented drive shaft 270 so as to cause the vertically oriented drive shaft 270 to be rotated around its longitudinal, vertically oriented axis. The upper end portion of the vertically oriented drive shaft 270 has a second rotary gear member 272 mounted thereon such that the second rotary gear member 272 is also rotatable around the vertical axis defined by means of the drive shaft 270, and the second rotary gear member 272 is enmeshed with a second transmission gear member 274. The second transmission gear member 274 is mounted upon a second horizontally oriented drive shaft 276 so as to be rotatable around the horizontal axis defined by means of the second horizontally oriented drive shaft 276, and a second conveyor belt drive pulley 278 is fixedly mounted upon the second horizontally oriented drive shaft 276 so as to be driven thereby.

The second conveyor belt drive pulley 278 is adapted to be operatively cooperative with a second conveyor belt idler pulley 280 so as to convey a second upper endless loop conveyor belt member, not shown, whereby the lower run of the second upper endless loop conveyor belt member, not shown, will operatively cooperate with the upper run of the first lower endless loop conveyor belt member, not shown, so as to effectively complete the magazine assembly for housing and serially conveying the plurality of vertically oriented external corner or edge protectors, not shown, toward the external corner or edge protector pickup, transfer, and applicator mechanism 248 in order to dispose the leading one of the external corner or edge protectors, not shown, at the desired forwardmost position such that the leading one of the external corner or edge protectors will in fact be ready to be picked up by means of the external corner or edge protector pickup, transfer, and applicator mechanism 248. More particularly, as can best be seen from FIGS. 3 and 5–7, a set of longitudinally spaced, laterally or transversely extending support beams 282,284 are respectively fixedly secured to the opposite dependent ends of substantially inverted C-shaped or U-shaped mounting brackets 286,288, and it is additionally seen that a side end portion of each one of the substantially inverted C-shaped or U-shaped mounting brackets 286,288 is respectively fixedly secured to a carriage block 290,292.

Still further, the second rotary gear member 272, and the second transmission gear member 274 enmeshed therewith, are disposed within a caged platform 294 which is fixedly secured atop one end of the laterally or transversely extending support beam 284, while the opposite end of the second, horizontally oriented pulley drive shaft 276 is rotatably mounted within a bearing block 296 which is fixedly secured atop one end of the laterally or transversely extending support beam 282. In a similar manner, the opposite ends of the rotary shaft, upon which the second conveyor belt idler pulley 280 is fixedly mounted, are mounted within bearing blocks 298,300 which are respectively fixedly secured atop the opposite ends of the laterally or transversely extending support beams 282,284, while a plurality of vertically spaced upper and lower idler rollers 302,304, interposed between the second conveyor belt drive pulley 278 and the second conveyor belt idler pulley 280 which are rotatably mounted upon the opposite ends of the laterally or transversely extending support beams 282,284, serve to respectively support and convey the upper and lower runs of the second upper endless loop conveyor belt member, not shown. In conjunction with the lower run of the second upper endless loop conveyor belt member, not shown, it is lastly noted, as can best be appreciated from FIG. 6, that a pair of secondary, laterally or transversely extending beam members 306,308 are respectively fixedly secured to the undersurface portions of the laterally or transversely extending support beams support beams 282,284 so as to project or extend inwardly toward each other, and in this manner, the pair of secondary, laterally or transversely extending beam members 306,308 effectively cooperate with the plurality of lower idler rollers 304 in defining a laterally or transversely oriented space within which the lower run of the second upper endless loop conveyor belt member, not shown, can be routed and confined. As has been noted hereinbefore, the lower run of the second upper endless loop conveyor belt member, not shown, is adapted to operatively cooperate with the upper run of the first lower endless loop conveyor belt member, not shown, so as to effectively complete the magazine assembly for housing and serially conveying the plurality of vertically oriented external corner or edge protectors, not shown, toward the external corner or edge protector pickup, transfer, and applicator mechanism 248.

Continuing further, in order to in fact permit the second upper endless loop conveyor belt member, not shown, to properly operatively cooperate with the first lower endless loop conveyor belt member, also not shown, such that the first and second lower and upper endless loop conveyor belt members together define the magazine assembly within which a plurality of different sized, vertically oriented external corner or edge protectors, not shown, can be housed or accommodated, and still further, in order to in fact permit the upper run of the first lower endless loop conveyor belt member, not shown, to properly operatively cooperate with the lower run of the second upper endless loop conveyor belt member, not shown, so as to convey such different sized, vertically oriented external corner or edge protectors toward the external corner or edge protector pickup, transfer, and applicator mechanism 248, the disposition of the second upper endless loop conveyor belt member, not shown, with respect to the first lower endless loop conveyor belt member, not shown, is rendered adjustable. More particularly, it will be appreciated that the various, aforenoted structural components comprising, for example, the second conveyor belt drive pulley 278, the second conveyor belt idler pulley 280, and the upper and lower idler rollers 302,304 over, under, and around which the second upper endless loop conveyor belt member, not shown, is movably disposed, as well as the transversely or laterally extending support beams 282,284, mounting brackets 286,288, and the carriage blocks 290, 292, effectively define a carriage assembly which is adapted to be vertically movable in a reciprocating manner so as to in fact render the disposition of the second upper endless loop conveyor belt member, not shown, positionally adjustable with respect to the first lower endless loop conveyor belt member, not shown.

Figure 3:
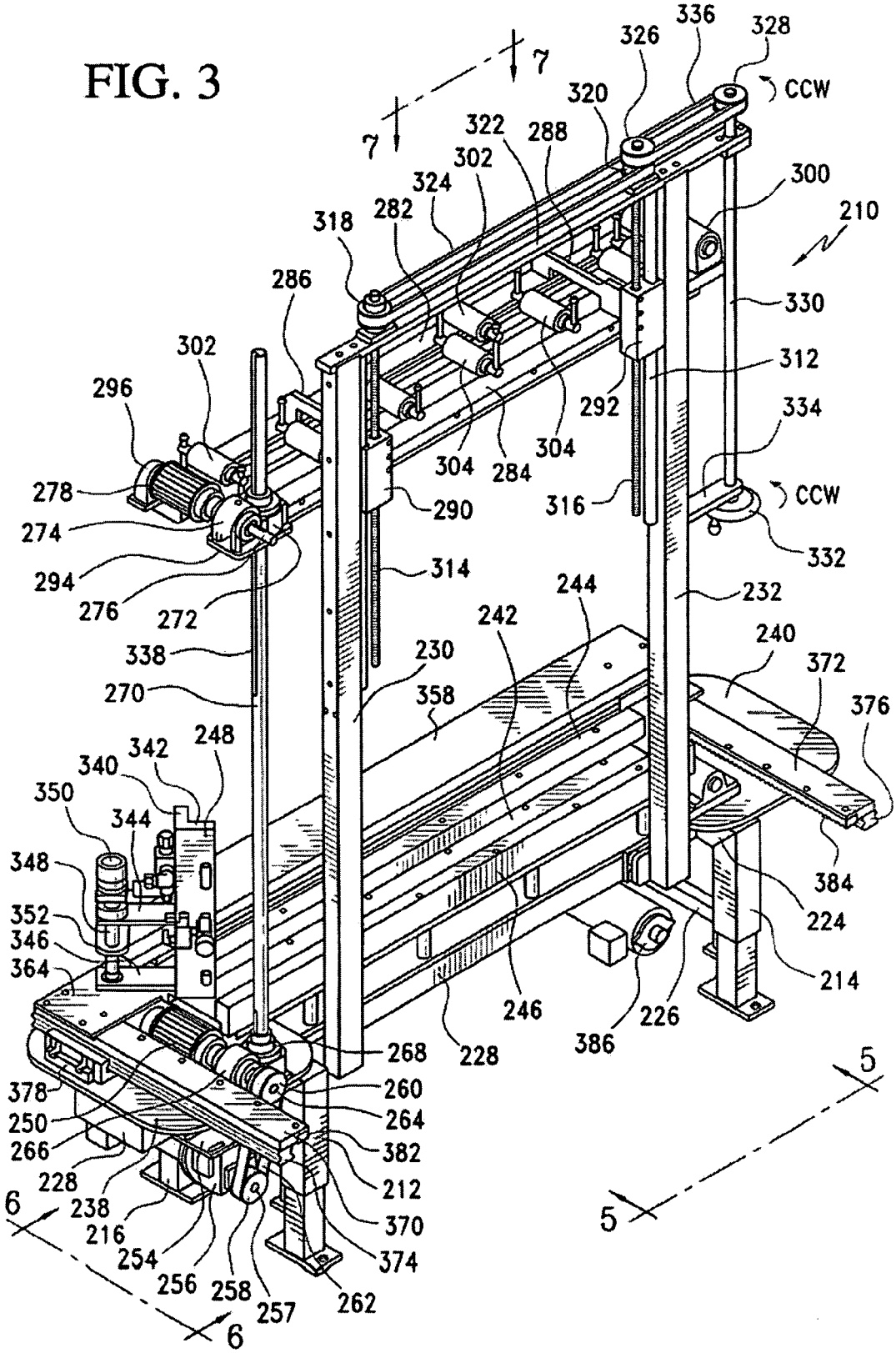
FIG. 3 is a partial perspective view of a new and improved apparatus or system, for wrapping or packaging palletized loads or articles within wrapping or packaging material, constructed in accordance with the principles and teachings of the present invention and showing the operative component parts thereof, in particular, the stationary disposition of the magazine assembly, upon the apparatus or system framework, for housing or storing the serial supply of external corner or edge protectors to be applied to external corner or edge regions of a palletized load or article, and the mounting of the pickup, transfer, and applicator mechanism upon the apparatus or system framework so as to be movable both longitudinally and laterally in X-Y directions independent of the magazine assembly.
Figure 5:
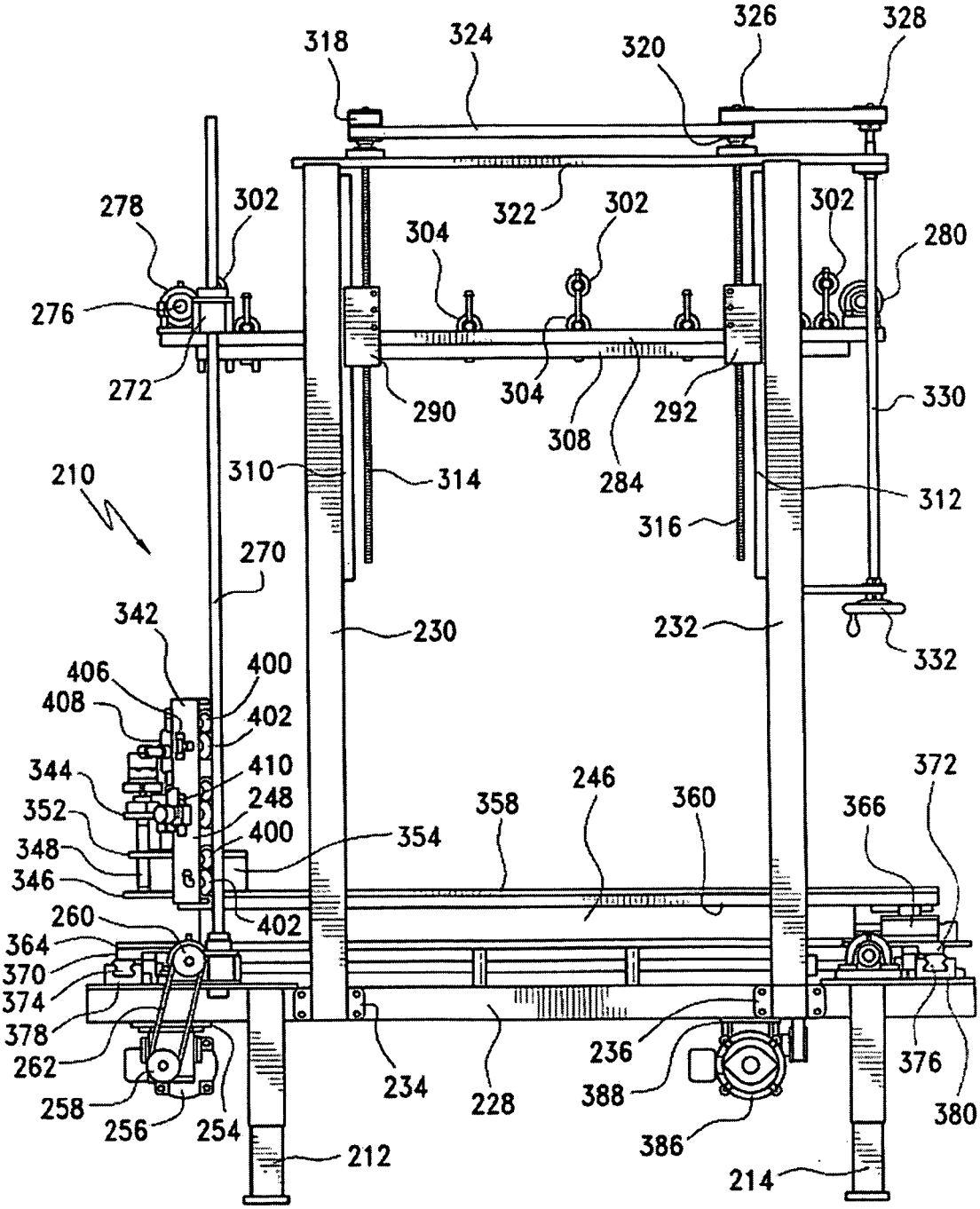
FIG. 5 is a front elevational view of the new and improved palletized load or article wrapping or packaging apparatus or system, as disclosed within FIG. 3, and as taken along the line 5—5 of FIG. 3.
Figure 6:
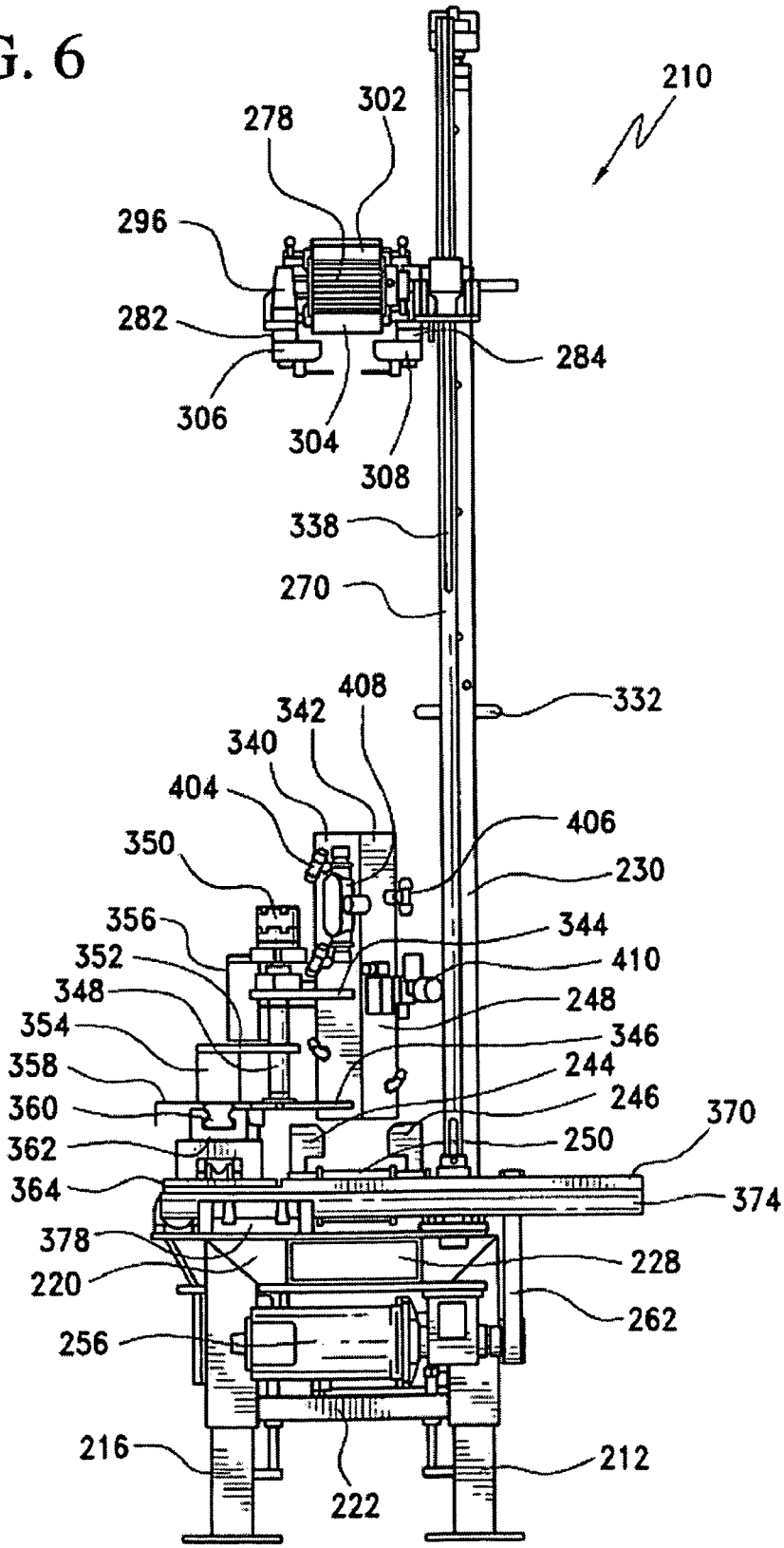
FIG. 6 is an end elevational view of the new and improved palletized load or article wrapping or packaging apparatus or system, as disclosed within FIG. 3, and as taken along the line 6—6 of FIG. 3.
Figure 7:
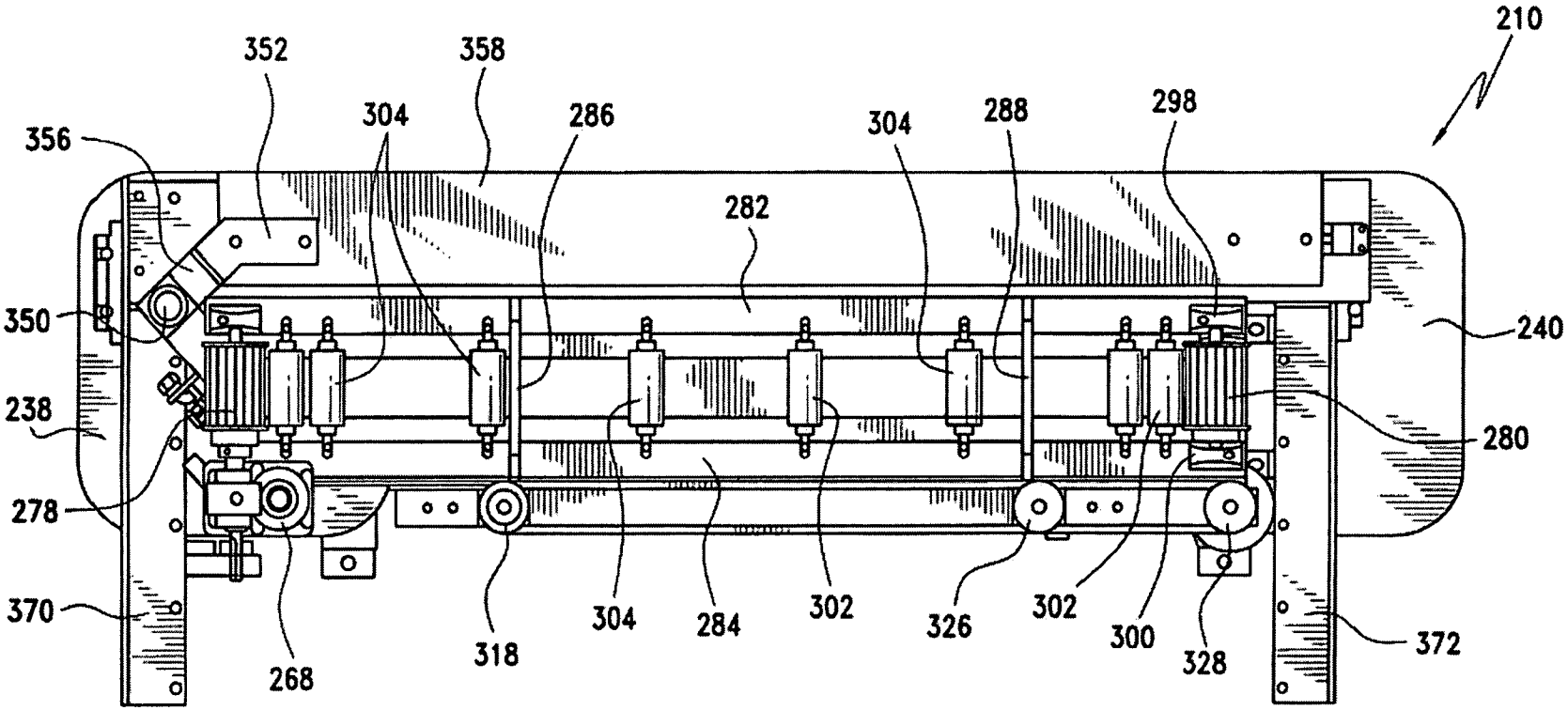
FIG. 7 is a top plan view of the new and improved palletized load or article wrapping or packaging apparatus or system, as disclosed within FIG. 3, and as taken along the line 7—7 of FIG. 3.

With reference therefore being continued primarily with respect to FIGS. 3, 5, and 6, it is seen that each one of the carriage blocks 290,292 is slidably mounted upon a vertically oriented guide rod 310,312 which are respectively fixedly mounted upon the vertically oriented, upstanding mast members 230,232, and that each one of the carriage blocks 290,292 is provided with an internally threaded bore through which a vertically oriented externally threaded rod 314,316 extends so as to be threadedly engaged therewith. The upper end portion of each one of the vertically oriented externally threaded rods 314,316 is respectively fixedly mounted within third and fourth pulley members 318, 320, and it is seen that the third and fourth pulley members 318,320 are rotatably mounted upon a laterally or transversely extending support plate 322 which is fixedly secured to the upper end portions of the vertically oriented, upstanding mast members 230,232. A second pulley belt 324 drivingly interconnects the third and fourth pulley members 318,320 together, and it is seen that a fifth pulley member 326 is likewise fixedly mounted upon the upper end portion of the externally threaded rod 316, while a sixth pulley member 328 is fixedly mounted upon the upper end portion of a vertically oriented drive shaft 330 which is adapted to be manually rotated by means of a handle assembly 332.

The upper end portion of the vertically oriented drive shaft 330 is rotatably mounted within the right end portion of the transversely or laterally extending support plate 322, while the lower end portion of the vertically oriented drive shaft 330 is rotatably mounted within a mounting bracket 334 which is fixedly secured to the vertically oriented, upstanding mast member 232, and a third pulley belt 336 drivingly interconnects the fifth and sixth pulley members 326,328 together. It can therefore be accordingly appreciated that when, for example, the rotary handle assembly 332 is rotated with the counterclockwise direction CCW as viewed and denoted within FIG. 3, the vertically oriented drive shaft 330 will likewise be rotated in the counterclockwise direction CCW whereby the sixth pulley member 328 will, in turn, be rotated in the counterclockwise direction CCW. The third pulley belt 336 will cause the fifth pulley member 326 to likewise rotate in the counterclockwise direction whereby the fourth pulley member 320, as well as the vertically oriented threaded rod 316, will likewise rotate in the counterclockwise direction. The rotational movement of the fourth pulley member 320 will be transmitted to the third pulley member 318, through means of the second pulley belt 324, whereby the third pulley member 318, as well as the vertically oriented threaded rod 314, will likewise-rotate in the counterclockwise direction.

The simultaneous rotational movements of the pair of threaded rods 314,316 in the counterclockwise direction will, of course, cause the carriage blocks 290,292 to be moved, for example, vertically upwardly so as to, in turn, cause the entire, aforenoted carriage assembly to be moved upwardly in order to enlarge the vertical separation defined between the first and second, upper and lower conveyor belts, not shown, whereby such first and second, upper and lower conveyor belts, not shown, can accommodate and house predeterminedly sized external corner or edge protectors within the aforenoted magazine assembly. It can of course be appreciated further that rotation of the rotary handle assembly 332 in the opposite, clockwise direction will cause the carriage blocks 290,292, and therefore, the entire carriage assembly, to be moved downwardly in order to lessen the vertical separation defined between the first and second, upper and lower conveyor belts, not shown, whereby such first and second, upper and lower conveyor belts, not shown, can accommodate and house predeterminedly smaller external corner or edge protectors within the aforenoted magazine assembly.

It is to be lastly appreciated that, in connection with the aforenoted vertically adjustable movements of the carriage assembly, the second rotary gear member 272 must be simultaneously capable of undergoing rotary movement, as a result of its enmeshed engagement with respect to the second transmission gear member 274, as well as vertically reciprocable translational movement as a result of effectively being mounted upon the transversely or laterally oriented support beam 284 which forms a part of the aforenoted carriage assembly. Accordingly, it is seen that the upper external surface portion of the vertically oriented drive shaft 270 is provided with a key slot 338, as can best be seen in FIGS. 3 and 6, and that the internal surface portion of the second rotary gear member 272 is correspondingly provided with a key member, not shown, which is adapted to be disposed within the key slot 338 of the vertically oriented drive shaft 270. In this manner, rotary motion, imparted to the vertically oriented drive shaft 270 by means of the first rotary gear member 268, can be transmitted from the vertically oriented drive shaft 270 to the second rotary gear member 272, and yet the second rotary gear member 272 is also permitted to move along the external surface portion of the vertically oriented drive shaft 270 as a result of the vertical adjustment movements of the carriage assembly.

Considering lastly the structural details of each one of the external corner or edge protector pickup, transfer, and applicator mechanisms 248, and the mounting of the same upon each one of the external corner or edge protector magazine and pickup, transfer, and applicator assemblies 210, it will be recalled that the magazine assembly, for housing the plurality of vertically oriented external corner or edge protectors, not shown, is stationary with respect to the wrapping or packaging station, at which the palletized load or article to be wrapped is located. More particularly, it has been disclosed that the only movable components of the magazine assembly comprise, for example, the first conveyor belt drive pulley 250, the first conveyor belt idler pulley 252, the second conveyor belt drive pulley 278, the second conveyor belt idler pulley 280, the upper and lower idler rollers 302,304, and the vertically movable carriage assembly comprising the transversely or laterally extending support beams 282,284, the mounting brackets 286,288, and the carriage blocks 290,292, whereby the disposition of the second upper endless loop conveyor belt member, not shown, is positionally adjustable with respect to the first lower endless loop conveyor belt member, not shown. In conjunction with the magazine assembly for housing the plurality of vertically oriented external corner or edge protectors, not shown, it is also desirable to mount each one of the external corner or edge protector pickup, transfer, and applicator mechanisms 248, with respect to its operatively associated magazine assembly, in such a manner that only the external corner or edge protector pickup, transfer, and applicator mechanisms 248 will be movable with respect to the wrapping or packaging station, at which the palletized load or article to be wrapped is located, or in other words, each one of the external corner or edge protector pickup, transfer, and applicator mechanisms 248 will be movable independently of its operatively associated magazine assembly, whereby the operational and logistical drawbacks, characteristic of the system disclosed, for example, within the aforenoted patent issued to Morantz et al., will not be encountered.

Figure 8:
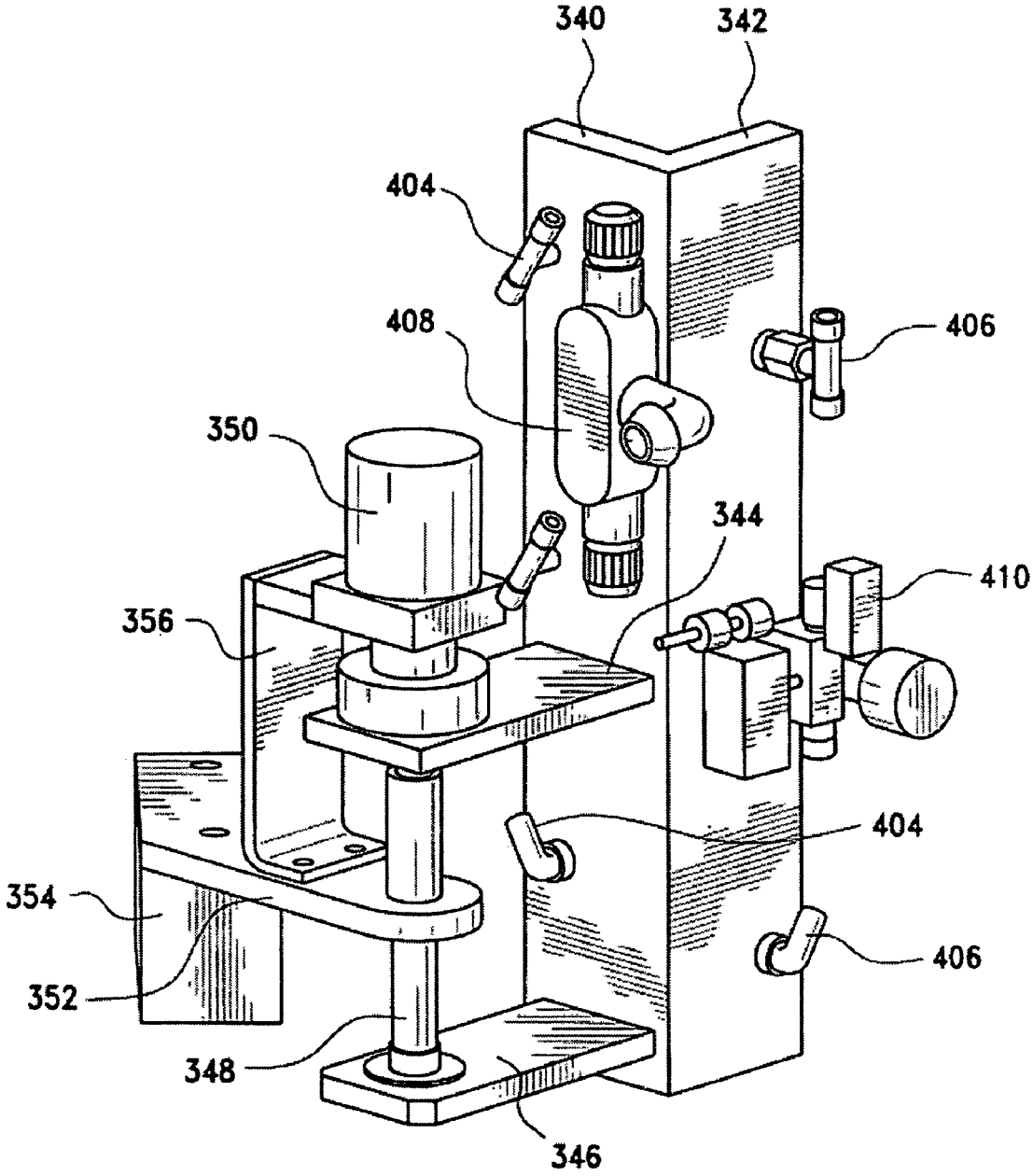
FIG. 8 is an enlarged perspective view of one of the pickup, transfer, and applicator mechanisms of the present invention showing the operative components thereof for mounting upon the apparatus or system framework.

In addition, it is also desirable to mount each one of the external corner or edge protector pickup, transfer, and applicator mechanisms 248, with respect to its operatively associated magazine assembly, in such a manner that, not only can each one of the external corner or edge protector pickup, transfer, and applicator mechanisms 248 remove the leading one of the vertically oriented external corner or edge protectors, not shown, from its operatively associated magazine assembly, but in addition, it is desirable to mount each one of the external corner or edge protector pickup, transfer, and applicator mechanisms 248 with respect to its operatively associated magazine assembly in such that manner that each one of the external corner or edge protector pickup, transfer, and applicator mechanisms 248 will be movable with respect to the wrapping or packaging station in accordance with two different modes of operation, that is, both longitudinally and laterally along X and Y axes. Still further, each one of the external corner or edge protector pickup, transfer, and applicator mechanisms 248 is to be capable of undergoing rotational or arcuate movement through means of an angular range of motion comprising 270°. More particularly, then, with reference being made to FIGS. 3–8, and in order to achieve the aforenoted movements of each one of the external corner or edge protector pickup, transfer, and applicator mechanisms 248, it is seen that each one of the external corner or edge protector pickup, transfer, and applicator mechanisms 248 comprises, in effect, a vertically oriented angle-iron which is formed by means of two leg members 340, 342 which are disposed at 90° with respect to each other as can best be seen in FIGS. 3 and 8. A pair of vertically spaced mounting brackets 344,346 fixedly mount the external corner or edge protector pickup, transfer, and applicator mechanism 248 upon the shaft 348 of a rotary actuator 350, and the central portion of the shaft 348 is rotatably mounted within a bearing plate 352 which, in turn, is fixedly secured upon a mounting block 354. A stabilizing bracket 356 also fixedly secures the rotary actuator 350 to the bearing plate 352, and the mounting block 354 is adapted to be fixedly mounted atop a laterally or transversely oriented upper support plate 358. As can best be appreciated from FIGS. 4 and 5, the laterally or transversely oriented upper support plate 358 is adapted to be fixedly secured atop a laterally or transversely oriented linear bearing member 360, and the laterally or transversely oriented linear bearing member 360 is adapted to be moved in a transverse or lateral reciprocal mode of operation so as to, in turn, enable the external edge or corner protector pickup, transfer, and applicator mechanism 248 to be moved reciprocally in the lateral or transverse directions X—X.

Continuing further, it is seen that the left end portion of the laterally or transversely oriented linear bearing member 360 is slidably mounted within a bearing block 362, and that the bearing block 362 is fixedly mounted upon a laterally or transversely oriented lower support plate 364. In addition, the right end portion of the laterally or transversely oriented linear bearing member 360 is fixedly attached to a rodless cylinder 366 which is adapted to be slidably moved in a reciprocal manner, in the X—X directions, along a laterally or transversely oriented guide rail 368 which is fixedly secured atop the laterally or transversely oriented lower support plate 364. The laterally opposite end portions of the laterally or transversely oriented lower support plate 364 are fixedly mounted upon a pair of transversely or laterally spaced, longitudinally oriented bracket plates 370,372, and each one of the transversely or laterally spaced, longitudinally oriented bracket plates 370,372 has a longitudinally oriented linear bearing member 374,376 fixedly secured to laterally outward undersurface portions of the laterally or transversely spaced, longitudinally oriented bracket plates 370,372. End portions of the longitudinally oriented linear bearing members 374,376 are respectively mounted within bearing blocks 378,380 which are fixedly secured atop the transversely or laterally spaced support or mounting platforms 238,240, and it is further seen, from FIGS. 3 and 4, that laterally inward undersurface portions of the laterally or transversely spaced, longitudinally oriented bracket plates 370,372 have longitudinally extending toothed rack members 382,384 fixedly mounted thereon.

The longitudinally extending rack members 382,384 are adapted to be movably disposed in accordance with longitudinally reciprocal modes of operations along the directions Y—Y by means which will be described shortly hereinafter. It can therefore be readily appreciated that since the longitudinally extending rack members 382,384 are fixedly mounted beneath the laterally or transversely spaced, longitudinally oriented bracket plates 370,372, that the laterally opposite end portions of the laterally or transversely oriented lower support plate 364 are fixedly secured to the transversely or laterally spaced, longitudinally oriented bracket plates 370, 372, that the laterally or transversely oriented linear bearing member 360 is slidably mounted upon the transversely or laterally oriented lower support plate 364 through means of the bearing block 362 and the rodless cylinder 366 which is movable along the laterally or transversely oriented guide rail 368, and that the external corner or edge protector pickup, transfer, and applicator mechanism 248 is mounted upon the laterally or transversely oriented linear bearing member 360 through means of the laterally or transversely oriented upper support plate 358, the external corner or edge protector pickup, transfer, and applicator mechanism 248 is able to be moved in the longitudinal directions Y—Y, in accordance with the longitudinally reciprocal modes of operations of the longitudinally extending rack members 382,384 along the directions Y—Y, as well as being able to be moved in the lateral or transverse directions X—X in accordance with the reciprocal movements of the laterally or transversely oriented linear bearing member 360.

Figure 4:
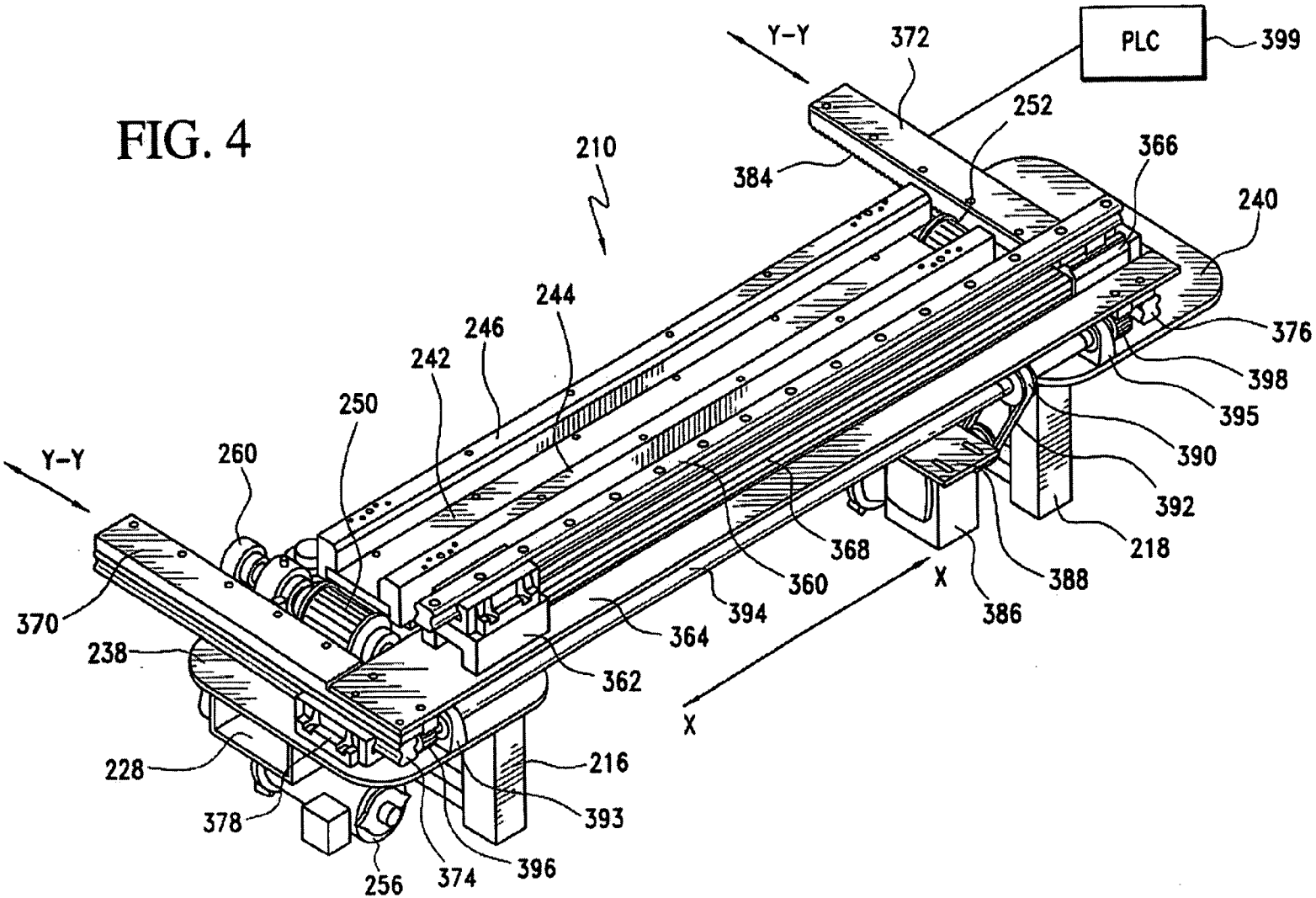
FIG. 4 is a partial perspective view, similar to that of FIG. 3 but from a mirror-image point of view, showing the details of the mounting assembly for the pickup, transfer, and applicator mechanism as mounted upon the apparatus or system framework.

In order to achieve the longitudinally reciprocal modes of operations of the longitudinally extending rack members 382,384 along the directions Y—Y, it is seen, as can best be appreciated from FIGS. 3–5, that a dual-directional second combination drive motor-gear reducer assembly 386 is fixedly mounted upon a second mounting bracket 388 which is fixedly secured to a right end undersurface portion of the transversely or laterally extending structural beam member 228. The output drive shaft of the second combination drive motor-gear reducer assembly 386 has a drive pulley, not visible in the drawings, mounted thereon, and the drive pulley, not visible in the drawings, is operatively connected to a driven pulley 390 by means of a pulley drive belt 392. The driven pulley 390 is fixedly mounted upon a rotary drive shaft 394, and the laterally opposite ends of the rotary drive shaft 394, which are mounted within bearing blocks 393, 395, have rotary pinions 396,398 fixedly mounted thereon so as to be rotatable therewith.

The rotary pinions 396,398 are respectively enmeshed with end portions of the longitudinally extending toothed rack members 382,384, and accordingly, as the second combination drive motor gear reducer assembly 386 is, for example, incrementally energized in either one of its two directional drive modes, rotary drive shaft 394 is accordingly rotated so as to drive the rotary pinions 396,398 which, in turn, can move the longitudinally extending rack members 382,384 in their longitudinal movement modes along the longitudinal directions Y—Y. It is to be additionally appreciated that all movements of the various structural components comprising the new and improved external corner or edge protector magazine and pickup, transfer, and applicator assembly 210 of the present invention, such as, for example, the first and second combination drive motor-gear reducer assemblies 256,386, the rotary actuator 350, and the rodless cylinder 366, are under the control of a suitable programmable logic controller (PLC) 399 which is schematically illustrated within FIG. 4. It is lastly noted, with reference being made to FIG. 8, as well as to FIGS. 5 and 6, that each one of the leg members 340, 342 of each one of the external corner or edge protector pickup, transfer, and applicator mechanisms 248 has a plurality of, for example, vacuum suction cup members 400,402 respectively mounted upon the inner surface portions thereof so as to be disposed toward the plurality of external corner or edge protectors, not shown, which are accommodated and housed within the magazine assembly defined between the upper and lower conveyor belt members, not shown. In addition, in order to respectively provide vacuum or suction forces to the vacuum suction cup members 400,402, a plurality of vacuum hose fittings 404,406, to be fluidically connected to a suitable source of vacuum pressure, are respectively fixed upon the external surface portions of the leg members 340,342 of each one of the external corner or edge protector pickup, transfer, and applicator mechanisms 248.

Still further, a suitable electrical fitting 408, which receives electrical power from a suitable power source, not shown, is mounted upon an external surface portion of the leg member 340 of each one of the external corner or edge protector pickup, transfer, and applicator mechanisms 248, and in a similar manner, a suitable pressure gauge, pressure switch mechanism, and vacuum generator assembly 410 is mounted upon an external surface portion of the leg member 342 of each one of the external corner or edge protector pickup, transfer, and applicator mechanisms 248. The various components of the pressure gauge, pressure switch mechanism, and vacuum generator assembly 410 are electrically connected to the electrical fitting 408 by means of suitable electrical connections, not shown for simplicity, and in a similar manner, the vacuum generator component will likewise be fluidically connected to the various vacuum hose fittings 404,406 by means of suitable vacuum hoses or tubular connections which are likewise not shown for simplicity. It is of course to be further appreciated that, as was the case with the various components comprising, for example, the first and second combination drive motor-gear reducer assemblies 256,386, and the rotary actuator 350, the various operational modes of supplying vacuum to the vacuum hose fittings 404,406 through means of the pressure gauge, pressure switch mechanism, and vacuum generator assembly 410, as well as electrical power to the electrical fitting 408, are also under the control of the programmable logic controller (PLC) 399.

Thus, it may be seen that in accordance with the principles and teachings of the present invention, there has been provided a new and improved apparatus, for placing external corner or edge protectors upon the external corner or edge regions of palletized loads or articles, prior to the wrapping or packaging of the palletized loads or articles within wrapping or packaging material, which comprises four corner protector pickup, transfer, and applicator mechanisms which are respectively disposed adjacent to the four external corner or edge regions of the palletized load or article. External corner or edge protector magazine assemblies are stationarily mounted upon the apparatus framework, and external corner or edge protector pickup, transfer, and applicator mechanisms are movable independently of the external corner or edge protector magazine assemblies. In particular, the external corner or edge protector pickup, transfer, and applicator mechanisms are rotatably mounted upon rotatable actuators which are rotatably movable through angular movements comprising 270°. The rotary actuators are also mounted upon linearly movable mechanisms which are movable in both X and Y directions, and therefore, the external corner or edge protector magazine assemblies, and the external corner protector pickup, transfer, and applicator mechanisms operatively associated therewith, are capable of being oriented either in a parallel mode, or in a perpendicular mode, with respect to the longitudinal extent of the longitudinal conveyor system which conveys the palletized loads or articles into and out from the wrapping or packaging station.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for placing external corner protectors upon external corner regions of an article disposed at a wrapping station in preparation for being wrapped within wrapping material, comprising:

a framework;

a magazine assembly stationarily mounted upon said framework for accommodating and housing a plurality of external corner protectors to be mounted upon external corner regions of an article disposed at a wrapping station in preparation for being wrapped within wrapping material;

a pickup, transfer, and applicator mechanism for applying an external corner protector onto an external corner region of the article disposed at the wrapping station; and conveyor means, operatively associated with said magazine assembly, for conveying the plurality of external corner protectors toward said pickup, transfer, and applicator mechanism;

said pickup, transfer, and applicator mechanism being mounted upon said framework so as to be movable, independent of and relative to said magazine assembly, between a first pickup position, at which said pickup, transfer, and applicator mechanism picks up a leading one of the plurality of external corner protectors, moved from said magazine assembly toward said pickup, transfer, and applicator mechanism by said conveyor means, and a second transfer and application position to which said pickup, transfer, and applicator mechanism transfers the leading one of the plurality of external corner protectors and applies the leading one of the external corner protectors onto the external corner region of the article disposed at the wrapping station.

2. The apparatus as set forth in claim 1, further comprising:

first means movably mounted upon said framework for undergoing movement in a first linear direction;

second means movably mounted upon said first means for undergoing movement in a second linear direction; and means for mounting said pickup, transfer, and applicator mechanism upon said second means such that when said first and second means respectively undergo movements along said first and second linear directions, said pickup, transfer, and applicator mechanism can be moved in said first and second linear directions so as to positionally adjust said pickup, transfer, and applicator mechanism with respect to an external corner region of the article upon which the leading one of the external corner protectors can be applied.

3. The apparatus as set forth in claim 2, wherein:

said first linear direction, along which said first means is movably mounted upon said framework, comprises a longitudinally oriented direction; and said second linear direction, along which said second means is movably mounted upon said first means, comprises a laterally oriented direction which is disposed substantially perpendicular to said first longitudinally oriented linear direction.

4. The apparatus as set forth in claim 3, wherein:

said first means, movably mounted upon said framework for undergoing movement in said first longitudinally oriented linear direction, comprises a pair of laterally spaced, longitudinally oriented linear bearings; and said second means, movably mounted upon said first means for undergoing movement in said second laterally oriented linear direction, comprises a laterally oriented linear bearing operatively connected to said pair of laterally spaced, longitudinally oriented linear bearings.

5. The apparatus as set forth in claim 4, further comprising:

a pair of toothed rack members respectively fixed upon said pair of laterally spaced, longitudinally oriented linear bearings; and rotary drive means rotatably mounted upon said frame member and having pinion means fixedly mounted upon opposite end portions thereof for enmeshed engagement with said pair of toothed rack members.

6. The apparatus as set forth in claim 4, further comprising:

a laterally oriented guide rail; and a rodless cylinder operatively mounted upon said guide rail and fixedly connected to said laterally oriented linear bearing.

7. The apparatus as set forth in claim 4, further comprising:

programmable logic control (PLC) means for operatively controlling said conveyor means operatively associated with said magazine assembly, said pickup, transfer, and applicator mechanism, said pair of laterally spaced, longitudinally oriented linear bearings, and said laterally oriented linear bearing.

8. The apparatus as set forth in claim 2, wherein:

said means for mounting said pickup, transfer, and applicator mechanism upon said second means comprises a rotary actuator.

9. The apparatus as set forth in claim 8, wherein:

said rotary actuator is capable of undergoing rotary arcuate movements encompassing 270° of movement such that said apparatus can be alternatively disposed in perpendicular and parallel modes with respect to the wrapping station.

10. The apparatus as set forth in claim 1, wherein said conveyor means, operatively associated with said magazine assembly stationarily mounted upon said framework for accommodating and housing the plurality of external corner protectors to be mounted upon the external corner regions of the article disposed at the wrapping station in preparation for being wrapped within wrapping material, comprises:

a first lower conveyor mechanism;

a second upper conveyor mechanism operatively cooperating with said first lower conveyor mechanism for conveying the plurality of external corner protectors toward said pickup, transfer, and applicator mechanism such that said pickup, transfer, and applicator mechanism can pick up the leading one of the external corner protectors from said magazine assembly and apply the leading one of the external corner protectors onto the external corner region of the article disposed at the wrapping station.

11. The apparatus as set forth in claim 10, wherein:

said first lower conveyor mechanism comprises a first drive pulley around which a first lower conveyor belt is adapted to be disposed;

said second upper conveyor mechanism comprises a second drive pulley around which a second upper conveyor belt is adapted to be disposed;

first rotary drive means is operatively connected to said first drive pulley so as to drive the first lower conveyor belt;

second rotary drive means is operatively connected to said second drive pulley so as to drive the second upper conveyor belt; and means interconnects said first and second rotary drive means so as to drive the first and second lower and upper conveyor belts together.

12. The apparatus as set forth in claim 10, further comprising:

means for adjustably mounting said second upper conveyor mechanism relative to said first lower conveyor mechanism such that said magazine assembly can accommodate and house different sized external corner protectors.

13. The apparatus as set forth in claim 12, wherein said means for adjustably mounting said second upper conveyor mechanism relative to said first lower conveyor mechanism comprises:

a vertically movable carriage assembly mounted upon said framework.

14. The apparatus as set forth in claim 13, wherein:

said framework comprises a pair of laterally spaced, vertically upstanding mast members; and said carriage assembly comprises a pair of carriage blocks fixedly connected to said second upper conveyor mechanism and movably mounted upon said pair of laterally spaced, vertically upstanding mast members.

15. The apparatus as set forth in claim 14, further comprising:

a pair of guide rods fixedly mounted upon said pair of laterally spaced, vertically upstanding mast members for guiding said pair of carriage blocks of said carriage assembly as said carriage assembly undergoes vertical movements;

a pair of vertically oriented threaded rods threadedly engaged with said pair of carriage blocks; and means for rotating said pair of vertically oriented threaded rods so as to cause said carriage blocks to be vertically moved along said pair of guide rods.

* * * * *